US008351810B2

(12) United States Patent
Choi

(10) Patent No.: US 8,351,810 B2
(45) Date of Patent: Jan. 8, 2013

(54) METHOD AND APPARATUS FOR CONTROLLING VOLTAGE OF IMAGE FORMING APPARATUS

(75) Inventor: Jeong-Jai Choi, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 228 days.

(21) Appl. No.: 12/805,730

(22) Filed: Aug. 17, 2010

(65) Prior Publication Data

US 2011/0085810 A1 Apr. 14, 2011

(30) Foreign Application Priority Data

Oct. 9, 2009 (KR) ..... 10-2009-0096404

(51) Int. Cl.
*G03G 15/00* (2006.01)
*G03G 15/16* (2006.01)

(52) U.S. Cl. ..... 399/66; 399/45

(58) Field of Classification Search ..... 399/45, 399/66, 38, 46, 55
See application file for complete search history.

(56) References Cited

U.S. PATENT DOCUMENTS

| | | | | |
|---|---|---|---|---|
| 2003/0118359 | A1* | 6/2003 | Ogiyama et al. | 399/45 |
| 2004/0052539 | A1* | 3/2004 | Shim et al. | 399/45 |
| 2006/0013602 | A1* | 1/2006 | Lee et al. | 399/45 |
| 2007/0172244 | A1* | 7/2007 | Lee et al. | 399/45 |
| 2007/0183803 | A1* | 8/2007 | Bae | 399/66 |

* cited by examiner

*Primary Examiner* — Sophia S Chen
(74) *Attorney, Agent, or Firm* — Staas & Halsey LLP

(57) ABSTRACT

According to a method and apparatus for controlling a voltage of an image forming apparatus, a transferring roll resistance, which indicates the resistance between a transferring roller and a photoconductor drum, is detected by applying a first voltage to the transferring roller. A transferring voltage, which corresponds to the detected transferring roll resistance, is applied to the transferring roller with reference to a transferring table which corresponds to the paper resistance, and a transferring is performed on a printing paper by using a transferring roller to which a transferring voltage is applied.

20 Claims, 9 Drawing Sheets

FIG. 4

41

42 43

| STANDARD ADC | PWM DR | |
|---|---|---|
| | Simplex | Duplex |
| ... | ... | ... |
| 530 | 388 | 362 |
| 531 | 389 | 363 |
| 532 | 390 | 364 |
| 533 | 391 | 365 |
| 534 | 392 | 366 |
| 535 | 393 | 367 |
| 536 | 394 | 368 |
| 537 | 395 | 369 |
| 538 | 396 | 370 |
| 539 | 397 | 371 |
| 540 | 398 | 372 |
| 541 | 399 | 373 |
| 542 | 400 | 374 |
| 543 | 401 | 375 |
| 544 | 402 | 376 |
| 545 | 403 | 377 |
| 546 | 404 | 378 |
| 547 | 405 | 379 |
| 548 | 406 | 380 |
| 549 | 407 | 381 |
| ... | ... | ... |

FIG. 5

51

| | HIGH RESISTANCE | MEDIUM RESISTANCE | | LOW RESISTANCE | |
|---|---|---|---|---|---|
| 52 FEEDBACK CURRENT | 4.4μA | 6.0μA | 7.0μA | 9.6μA | 10.6μA |
| 53 ADC VOLTAGE | 0.72V | 0.93V | 1.21V | 1.53V | 1.87V |
| 54 STANDARD ADC | 223 | 289 | 375 | 475 | 580 |
| 55 Range | 0-280 | 281-470 | | 471-1024 | |
| 56 SECOND TRANSFERRING TABLE | Table A | Table B | | Table C | |

FIG. 6

61

| | | STANDARD VOLTAGE | 350V |
|---|---|---|---|
| | | PWM DR | 860 |
| 62 PAPER RESISTANCE | 63 PRINTING ENVIRONMENT (HH) | 64 PWM DR | VOLTAGE 65 |
| LOW RESISTANCE | +0 | 860 | 350V |
| MEDIUM RESISTANCE | +78 | 938 | 400V |
| HIGH RESISTANCE | +111 | 971 | 450V |

METHOD AND APPARATUS FOR CONTROLLING VOLTAGE OF IMAGE FORMING APPARATUS

CROSS-REFERENCE TO RELATED APPLICATIONS

This application claims the benefit of Korean Patent Application No. 10-2009-0096404, filed on Oct. 9, 2009, in the Korean Intellectual Property Office, the disclosure of which is incorporated herein in its entirety by reference.

BACKGROUND

1. Field

The embodiments relate to a method and apparatus to control a voltage of an image forming apparatus.

2. Description of the Related Art

Image forming apparatuses form an image on a printing paper by using a dot printing method, an inkjet printing method, or a laser printing method. Also, in order to form an image on a printing paper, electrophotographic image forming apparatuses include processes of charging, exposing, developing, transferring, and fixing. Here, the printing paper on which an image is formed using an image forming apparatus has various resistances according to a manufacturing environment, and a resistance of a transferring roller included in the image forming apparatus changes according to a period and environment of use. Accordingly, since the resistances of the printing paper and the transferring roller are not the same, the quality of an image formed on the printing medium varies.

SUMMARY

Accordingly, it is an aspect of the embodiments to provide a method and apparatus to control a voltage of an image forming apparatus in order to improve an image formed on a printing paper.

Additional aspects and/or advantages will be set forth in part in the description which follows and, in part, will be apparent from the description, or may be learned by practice of the embodiments.

The foregoing and/or other aspects are achieved by providing a method of controlling a voltage of an image forming apparatus, the method including: detecting a transferring roll resistance, which indicates a resistance between a transferring roller and a photoconductor drum, including applying a first voltage to the transferring roller; when a printing paper reaches a conductive member of which one surface thereof is opposite to the photoconductor drum, detecting a paper resistance, which indicates a resistance between the printing paper and the photoconductor drum, including applying a second voltage to the conductive member, wherein the printing paper and the conductive member are spaced apart from each other; applying a transferring voltage, which corresponds to the detected transferring roll resistance, to the transferring roller with reference to a transferring table which corresponds to the detected paper resistance; and performing transferring on the printing paper comprising using the transferring roller to which the transferring voltage is applied.

The foregoing and/or other aspects are achieved by providing a computer-readable recording medium having embodied thereon a computer program for executing the method above.

The foregoing and/or other aspects are achieved by providing an apparatus to control a voltage of an image forming apparatus, the apparatus including: a conductive member having a surface opposite to a photoconductor drum of the image forming apparatus; a transferring roll resistance detecting unit to detect a transferring roll resistance, which indicates the resistance between a transferring roller of the image forming apparatus, to which a first voltage is applied, and the photoconductor drum; a paper resistance detecting unit to detect a paper resistance, which indicates the resistance between a printing paper passing through the image forming apparatus, which reaches the conductive member to which a second voltage is applied, and the photoconductor drum, wherein the printing paper and the conductive member are spaced apart from each other; and a voltage applying unit to apply a transferring voltage, which corresponds to the detected transferring roll resistance, to the transferring roller with reference to a transferring table which corresponds to the detected paper resistance.

The foregoing and/or other aspects are achieved by providing an image forming apparatus including: a photoconductor drum; a charge roller to charge the photoconductor drum; a laser scanning unit to form an electrostatic latent image on the charged photoconductor drum; a development roller to develop a visible image to the photoconductor drum on which the electrostatic latent image is formed; a transferring roller transferring the visible image developed to the photoconductor drum to a printing paper; a fixing unit to fix the transferred visible image to the printing paper; and an apparatus to control a voltage applied to the transferring roller according to a paper resistance, which indicates the resistance between the printing paper and the photoconductor drum.

BRIEF DESCRIPTION OF THE DRAWINGS

These and/or other aspects and advantages will become apparent and more readily appreciated from the following description of the embodiments, taken in conjunction with the accompanying drawings of which:

FIG. 4 shows a transferring table according to an embodiment;

FIG. 5 is a table for describing a method of selecting a second transferring table by using detected paper resistance, according to an embodiment;

FIG. 6 is a table for describing a method of controlling the voltage applied to a pressuring roller by using detected paper resistance, according to an embodiment;

DETAILED DESCRIPTION

Figure 1:
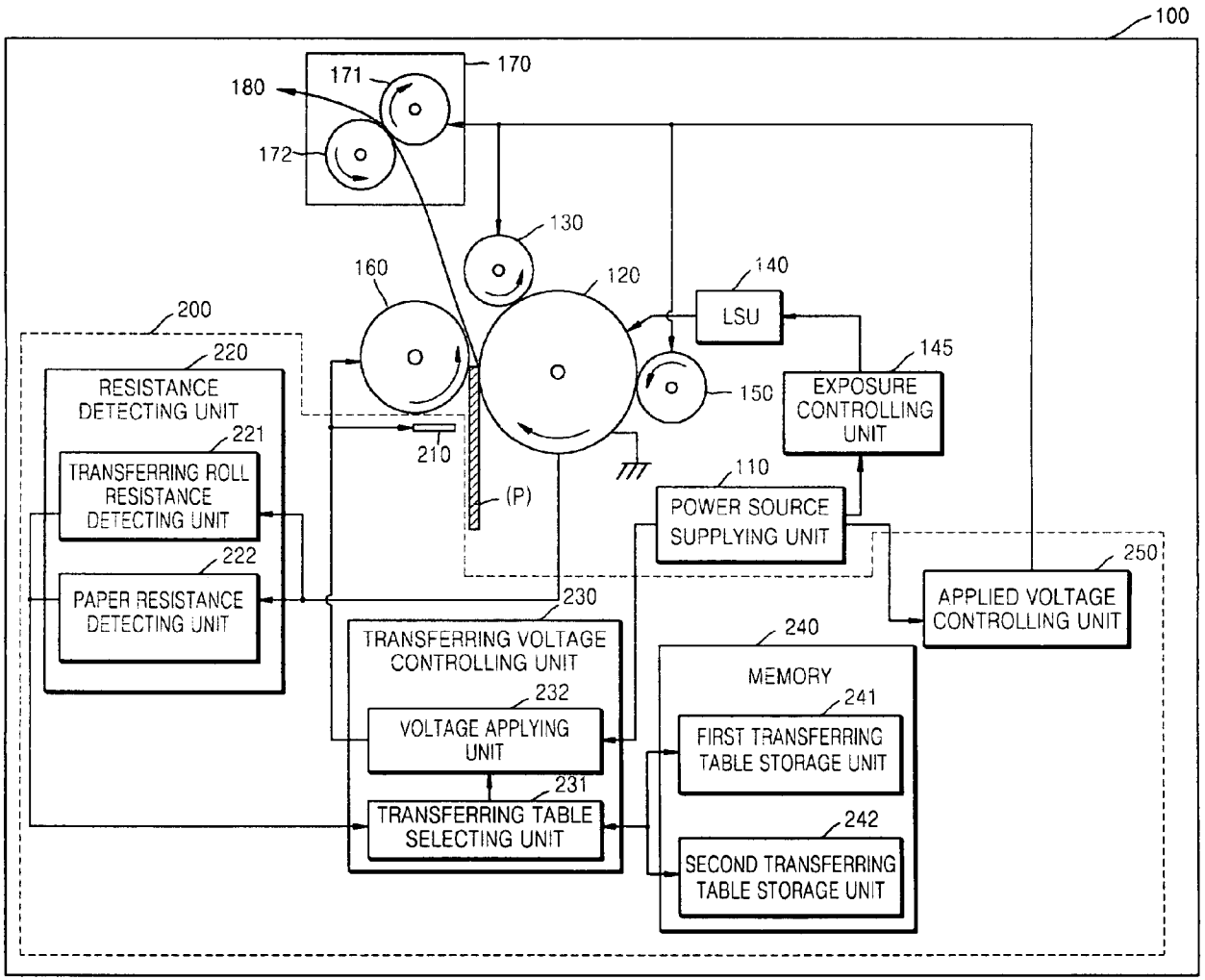
FIG. 1 is a diagram schematically illustrating an image forming apparatus to which a method of controlling a voltage according to an embodiment.

Reference will now be made in detail to the embodiments, examples of which are illustrated in the accompanying drawings, wherein like reference numerals refer to the like elements throughout. The embodiments are described below by referring to the figures.

FIG. 1 is a diagram schematically illustrating an image forming apparatus 100 to which a method of controlling a voltage according to an embodiment is applied. Referring to FIG. 1, the image forming apparatus 100 includes a power source supplying unit 110, a photoconductor drum 120, a charge roller 130, a laser scanning unit (LSU) 140, an exposure controlling unit 145, a development roller 150, a transferring roller 160, a fixing unit 170, and an apparatus 200 to control a voltage. Also, the fixing unit 170 includes a pressurizing roller 171 and a heating roller 172. The apparatus 200 includes a conductive member 210, a resistance detecting unit 220, a transferring voltage controlling unit 230, a memory 240, and an applied voltage controlling unit 250. Here, the resistance detecting unit 220 includes a transferring roll resistance detecting unit 221 and a paper resistance detecting unit 222. The transferring voltage controlling unit 230 includes a transferring table selecting unit 231 and a voltage applying unit 232. The memory 240 includes a first transferring table storage unit 241 and a second transferring storage unit 242.

The image forming apparatus 100 illustrated in FIG. 1 includes elements relating to the embodiment of FIG. 1. Accordingly, it would be apparent to one of ordinary skill in the art that other common elements can be further included, in addition to the elements illustrated in FIG. 1. In addition, for convenience of description, the apparatus 200 in FIG. 1 is combined to the image forming apparatus 100. However, the embodiment of FIG. 1 is not limited thereto and the apparatus 200 may separately exist to control a voltage of the image forming apparatus 100.

Referring to FIG. 1, the photoconductor drum 120, the charge roller 130, the development roller 150, the transferring roller 160, the pressurizing roller 171, and the heating roller 172 rotate by predetermined cycles about their corresponding reference axes in arrow directions as illustrated in FIG. 1. Here, a direction shown by the arrows in FIG. 1 is only an example and it is understood that these elements may rotate in the opposite direction. Also, the predetermined cycles may vary according to a use environment of the image forming apparatus 100.

The power source supplying unit 110 supplies a power source to the image forming apparatus 100. That is, the power source supplying unit 110 drives the image forming apparatus 100 by using external power. Also, the power source supplying unit 110 supplies a high voltage to the charge roller 130, the development roller 150, the transferring roller 160, and the fixing unit 170 through the transferring voltage controlling unit 230 or the applied voltage controlling unit 250. Here, the power source supplying unit 110 includes a high voltage power supply (HVPS) to supply a high voltage.

The charge roller 130 receives a high negative voltage from the power source supplying unit 110, which is controlled by the applied voltage controlling unit 250, and charges the photoconductor drum 120 to a regular negative potential. That is, the charge roller 130 has a negative potential due to a negative charge voltage, and contacts a surface of the photoconductor drum 120. Thus, the surface of the photoconductor drum 120 has a uniform charge with the charge roller 130. Accordingly, since the surface of the photoconductor drum 120 has a negative potential, the photoconductor drum 120 is charged to a regular negative potential.

The LSU 140 scans a laser beam obtained according to the control of the exposure controlling unit 145 on the photoconductor drum 120 charged to a negative potential. Thus, a portion of the photoconductor drum 120 on which an image is formed by the laser beam scanned from the LSU 140 is exposed and an electrostatic latent image is formed thereon. Here, the portion of the photoconductor drum 120 which is not exposed to the laser beam of the LSU 140 has a negative charge and a portion of the photoconductor drum 120 which is exposed to the laser beam of the LSU 140, that is, a portion on which an electrostatic latent image is formed, has a relatively lower negative charge than that of the non-exposed portion.

The development roller 150 receives a negative development bias voltage from the power source supplying unit 110, which is controlled by the applied voltage controlling unit 250, and attaches a toner charged with a negative potential to the portion of the photoconductor drum 120 on which an electrostatic latent image is formed. Accordingly, a visible image is formed on the surface of the photoconductor drum 120 with a developing agent such as a toner.

The transferring roller 160 receives a high positive transferring voltage from the power source supplying unit 110, which is controlled by the transferring voltage controlling unit 230, and attaches the toner attached to the photoconductor drum 120, to a printing paper P by using the high positive transferring voltage. A process of attaching the toner attached to the photoconductor drum 120 to the printing paper P is referred to as a transferring process. Also, in the embodiment of FIG. 1, the transferring roller 160 adopts an electron conduction method using an ethylene propylene dimonomer (EPDM) sponge, and uses a resistance range of 60 MΩ to 240 MΩ.

The fixing unit 170 fixes the developing agent such as the toner attached to the printing paper P to the printing paper P by using heat and pressure. Referring to FIG. 1, the fixing unit 170 includes the pressurizing roller 171 and the heating roller 172. The pressurizing roller 171 receives a high positive transferring voltage from the power source supplying unit 110, which is controlled by the transferring voltage controlling unit 230. The fixing unit 170 applies heat and pressure to the printing paper P to which the toner is attached, and thus fixes the toner to the printing paper P. As the toner is fixed to the printing paper P, when the printing paper P is discharged from the image forming apparatus 100, an image forming process is completed.

While the transferring process is performed, the quality of an image transferred to the printing paper P is determined according to the voltage applied to the transferring roller 160, wherein the voltage applied to the transferring roller 160 affects the life of transferring rolls such as the transferring roller 160 and the photoconductor drum 120. A voltage applied to the transferring roller 160 is applied from the power source supplying unit 110, which is controlled by the transferring voltage controlling unit 230, and the transferring voltage controlling unit 230 controls a transferring voltage applied to the transferring roller 160 by considering a printing environment, transferring roll resistance, and paper resistance. However, it is understood that the examples are not limited thereto.

The resistance detecting unit 220 detects the transferring roll resistance and paper resistance. Here, the transferring roll resistance denotes the resistance between the transferring roller 160 and the photoconductor drum 120 and the paper resistance denotes the resistance between the printing paper P and the photoconductor drum 120. Referring to FIG. 1, the resistance detecting unit 220 includes the transferring roll resistance detecting unit 221 and the paper resistance detecting unit 222 in order to detect the transferring roll resistance and the paper resistance, respectively.

When the transferring roller 160 and the photoconductor drum 120 form a nip, the transferring roll resistance detecting unit 221 detects the transferring roll resistance indicating the resistance between the transferring roller 160, to which a first voltage is applied, and the photoconductor drum 120. Here, the first voltage is applied from the power source supplying unit 110 by the control of the transferring voltage controlling unit 230. The first voltage is used to detect the transferring roll resistance and may be, for example, 1400 V. However, the embodiment of FIG. 1 is not limited thereto.

That is, when the transferring roller 160 and the photoconductor drum 120 form a nip, the transferring voltage controlling unit 230 applies the first voltage to the transferring roller 160 and the transferring roll resistance detecting unit 221 detects the transferring roll resistance between the transferring roller 160 and the photoconductor drum 120. When the first voltage is applied to the transferring roller 160, a circuit including the transferring roller 160 and the photoconductor drum 120 is formed and accordingly, the transferring roll resistance detecting unit 221 detects current flowing from the photoconductor drum 120 to a grounding connected to the photoconductor drum 120. Here, the transferring roll resistance detecting unit 221 may detect the transferring roll resistance by performing a calculation according to Ohm's law using the first voltage applied to the transferring roller 160 and the detected current. However, it is understood that the transferring roll resistance detecting unit 221 may predict the transferring roll resistance only with reference to the detected current.

The paper resistance detecting unit 222 detects the paper resistance indicating the resistance between the printing paper P that reached the conductive member 210 to which a second voltage is applied and the photoconductor drum 120. Here, the second voltage is applied from the power source supplying unit 110 according to the control of the transferring voltage controlling unit 230. The second voltage has discrimination for the paper resistance in order to detect the paper resistance and may be, for example, 2 KV. However, the embodiment of FIG. 1 is not limited thereto. Both paper and an overhead projector (OHP) film that are transferred in an arrow direction 180 illustrated in FIG. 1 may be used instead of the printing paper P.

That is, when the printing paper P reaches the conductive member 210 positioned to face the photoconductor drum 120 and separates from the conductive member 210, the transferring voltage controlling unit 230 applies the second voltage to the conductive member 210 and the paper resistance detecting unit 222 detects the paper resistance between the printing paper P and the photoconductor drum 120. When the second voltage is applied to the conductive member 210, the second voltage is discharged to the printing paper P from the conductive member 210 and thus a circuit including the printing paper P and the photoconductor drum 120 is formed. Accordingly, the paper resistance detecting unit 222 detects the current flowing from the photoconductor drum 120 to a grounding connected to the photoconductor drum 120. Here, the paper resistance detecting unit 222 performs a calculation according to Ohm's law by using the second voltage applied to the conductive member 210 and the detected current to detect the paper resistance. However, it is understood that the paper resistance detecting unit 222 may predict the paper resistance only with reference to the detected current.

Accordingly, the paper resistance detecting unit 222 may detect the paper resistance which is not related to the resistance of the transferring roller 160. That is, the paper resistance detecting unit 222 may detect the resistance of the printing paper P without being affected by a resistance change according to long use of the transferring roller 160 and thus the printing quality of the image forming apparatus 100 may be improved.

In addition, the paper resistance detecting unit 222 detects the paper resistance, wherein the printing paper P and the conductive member 210 are spaced apart from each other, and thus the resistance of the conductive member 210 is not considered while detecting the paper resistance. As such, the paper resistance is not detected while the printing paper P is contacted and thus the accuracy of detecting the paper resistance may be improved.

Moreover, the second voltage of the conductive member 210 is discharged to the printing paper P from the conductive member 210 without being contacted with the printing paper P so that the image forming apparatus 100 according to the embodiment of FIG. 1 may prevent the conductive member 210 from being worn.

Figure 2:
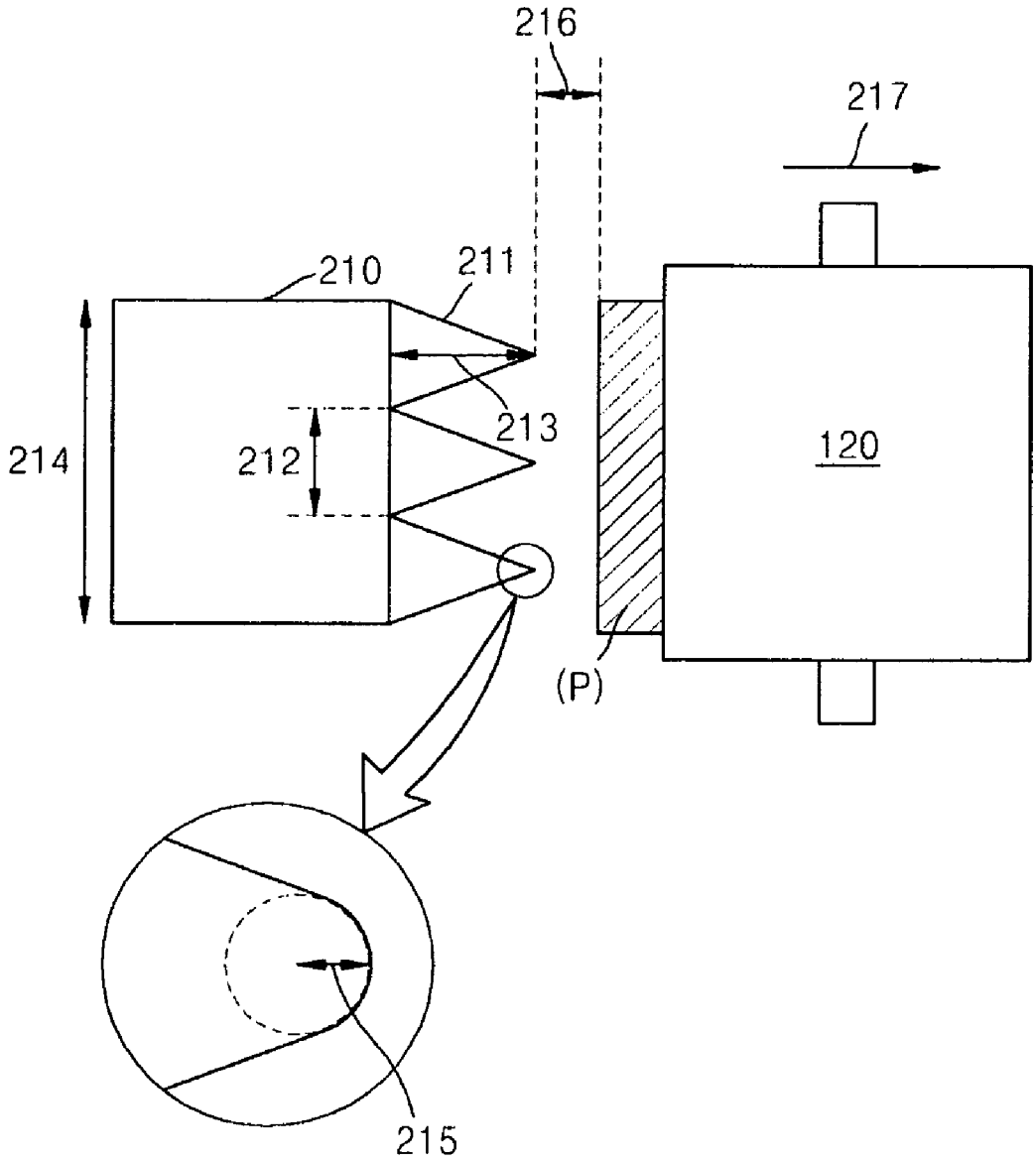
FIG. 2 is a diagram illustrating in more detail a conductive member, a printing paper, and a photoconductor drum of FIG. 1, according to an embodiment.

More specifically, the conductive member 210 is a plate including a saw-like surface formed to include at least one saw tooth facing the photoconductor drum 120. FIG. 2 is a diagram illustrating in more detail the conductive member 210, the printing paper P, and the photoconductor drum 120 of FIG. 1, according to an embodiment. Referring to FIG. 2, the conductive member 210 includes a saw-like plate having at least one saw tooth 211. Also, the conductive member 210 is formed of a conductive material, for example, stainless steel. The saw tooth 211 has a height 213 of about 4 mm and a base length 212 of about 4 mm. The conductive member 210 may have a length 214 of about 220 mm. The size of the conductive member 210 and the material for forming the conductive member 210 are only examples, and it is understood that the conductive member 210 may have an appropriate size and be formed of a material to detect the paper resistance.

The conductive member 210 is in the saw-like form. However, the conductive member 210 may have any form to discharge a voltage to the printing paper P in order to detect the paper resistance indicating the paper resistance of the printing paper P and the photoconductor drum 120, wherein the conductive member 210 is spaced apart from the printing paper P. The saw-like form according to the embodiment of FIG. 2 is only an example of the form of the conductive member 210 and the conductive member 210 may be in any form to discharge a voltage to the printing paper P, wherein the conductive member 210 is spaced apart from the printing paper P.

Since the high second voltage (for example, 2 kV) is applied to the conductive member 210, the second voltage may be discharged to the printing paper P, wherein the conductive member 210 is spaced apart from the printing paper P. Here, the end part of the saw tooth 211 included in the conductive member 210 has a form to discharge the voltage applied to the conductive member 210 to the printing paper P. Accordingly, as the surfaces of the end part of the saw tooth 211 converge at a point, discharging of a voltage is more efficient. However, according to another embodiment, the end part of the saw tooth 211 may be in the form of a circle having a predetermined radius 215. Here, the predetermined radius 215 may be approximately 0.3 mm or less. However, the predetermined radius 215 of 0.3 mm is only an example. Also, it would be understood that the saw tooth 211 may have various other forms.

In addition, according to a transferring direction 217, when the printing paper P reaches between the conductive member 210 and the photoconductor drum 120, the printing paper P contacts the photoconductor drum 120 and is spaced apart from the conductive member 210 by a distance 216. Here, the distance 216 between the printing paper P and the end part of the conductive member 210 may be in the range of about 0.5 mm to about 3 mm. The distance 216 which is in the range of about 0.5 mm to about 3 mm is only an example to discharge a voltage to the printing paper P in the conductive member 210 and the distance between the printing paper P and the end part of the conductive member 210 is not limited thereto.

Figure 3:
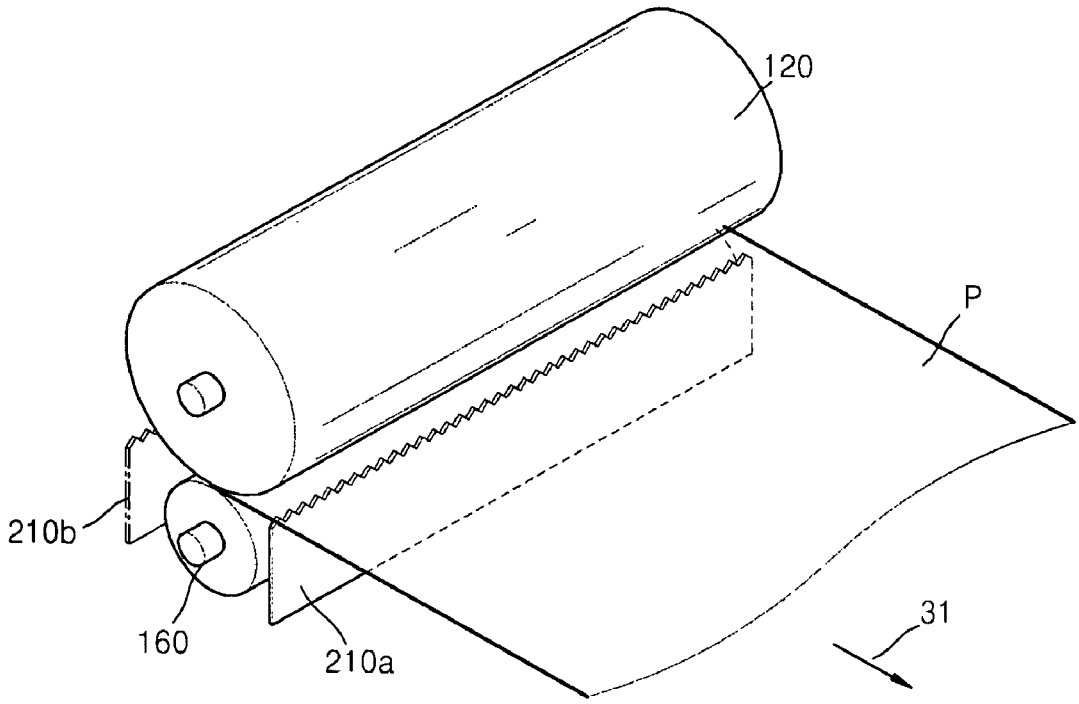
FIG. 3 is a diagram illustrating in more detail a location of the conductive member of FIG. 2, according to an embodiment.

FIG. 3 is a diagram illustrating in more detail a location of the conductive member 210 of FIG. 2, according to an embodiment. Referring to FIG. 3, the photoconductor drum 120 and the transferring roller 160 form a nip and the printing paper P passes through the photoconductor drum 120 and the transferring roller 160 through which the nip is formed through a transferring direction 31.

The conductive member 210 may be located before or after the transferring roller 160 based on the transferring direction 31 of the printing paper P. In FIG. 3, a conductive member 210*b* located before the transferring roller 160 based on the transferring direction 31 of the printing paper P and a conductive member 210*a* located after the transferring roller 160 based on the transferring direction 31 of the printing paper P are illustrated.

Referring back to FIG. 1, the transferring voltage controlling unit 230 controls the power source supplying unit 110 and thus controls a voltage applied to the transferring roller 160 and the conductive member 210. Referring to FIG. 1, the transferring voltage controlling unit 230 includes the transferring table selecting unit 231 and the voltage applying unit 232.

The transferring table selecting unit 231 selects any one transferring table which corresponds to the resistance detected by the resistance detecting unit 220 from among transferring tables stored in the memory 240. Here, the transferring table shows voltages applied to the transferring roller 160 according to transferring roll resistance and it is understood that the voltages applied to the transferring roller 160 are not limited to the voltage and include duty ratios of pulse width modulation (PWM) to control the voltage.

More specifically, the transferring table includes a first transferring table group and a second transferring table group, wherein the first transferring table group, which is not related to the paper resistance, shows voltages applied to the transferring roller 160 according to transferring roll resistance for a plurality of printing environments. The second transferring table group shows voltages applied to the transferring roller 160 according to transferring roll resistance for a plurality of paper resistances.

FIG. 4 shows a transferring table 41 according to an embodiment. Referring to FIG. 4, the transferring table 41, a standard analog to digital converter (ADC) 42, and a PWM duty ratio (DR) 43 are illustrated. As illustrated in FIG. 4, the transferring table 41 may be formed as a look-up table (LUT).

The standard ADC 42 denotes values in areas obtained by converting the current detected by the transferring roll resistance detecting unit 221 into ADC voltage based on a regular voltage, and classifying the converted ADC voltage in a predetermined number of areas. For example, when current of about 6 μA is detected by the transferring roll resistance detecting unit 221 and the detected current is converted into an ADC voltage based on a voltage of about 3.3 V, an ADC voltage becomes about 0.93 V, and 0.93 V may have a value of 289 as a standard ADC according to the result of classifying a voltage of 3.3 V in about 1024 areas.

The PWM DR 43 represents duty ratios which correspond to the standard ADC 42 by being classified into simplex printing and duplex printing. Accordingly, the transferring voltage controlling unit 230 controls a voltage applied from the power source supplying unit 110 by using the duty ratio which corresponds to the standard ADC 42 corresponding to the transferring roll resistance detected by the transferring roll resistance detecting unit 221. It would be understood that to control a voltage by using a PMW DR is described above and thus a detailed description thereof is omitted.

Accordingly, the first transferring table group includes transferring tables as in the transferring table 41 illustrated in FIG. 4 for each of the plurality of printing environments and the second transferring table group includes transferring tables as in the transferring table 41 illustrated in FIG. 4 for each of the plurality of paper resistance sizes.

The first transferring table group includes transferring tables for each of the plurality of printing environments. The first transferring table group is drawn only by considering influences of the printing environments. Here, the first transferring table group may be drawn based on one paper resistance (for example, standard paper resistance) regardless of the paper resistance. Also, the printing environment according to the embodiment of FIG. 4 denotes a sensed temperature in degrees and humidity in the image forming apparatus 100. For example, other transferring tables may exist according to various printing environments such as LL, HH, NN, Ultra LL, LL−, LL+, HH−, HH+, and Ultra HH, wherein LL denotes low temperature and low humidity, HH denotes high temperature and high humidity, NN denotes a normal state, ultra LL denotes extremely low temperature and low humidity, and ultra HH denotes extremely high temperature and high humidity. Also, LL− denotes temperature and humidity is between ultra LL and LL, LL+ denotes temperature and humidity is between LL and NN, HH− denotes temperature and humidity is between NN and HH, HH+ denotes temperature and humidity is between HH and ultra HH. That is, the first transferring table group which is drawn by considering influences of the printing environments including the transferring table applied in LL and the transferring table applied in HH, etc. may be stored in the first transferring table storage unit 241 of the memory 240. The temperature and humidity which determine the printing environment, in the embodiment of FIG. 4, are only examples and the embodiment is not limited thereto.

For example, as temperature and humidity, which are printing environments, increase, the first transferring table group may include a plurality of transferring tables formed for a voltage gradually applied from the power source supplying unit 110.

The second transferring table group includes transferring tables for each of the plurality of paper resistance sizes. The second transferring table group is drawn by considering all paper resistances and printing environments. For example, the plurality of paper resistance sizes may be divided into low resistance, medium resistance, and high resistance, and transferring tables for each of the plurality of printing environments exist for each resistance. That is, the second transferring table group which is drawn by considering paper resistance and the influences of the printing environments including the transferring table applied in low resistance LL, the transferring table applied in low resistance NN, the transferring table applied in low resistance HH, and the transferring table applied in medium resistance LL, etc. may be stored in the second transferring table storage unit 242 of the memory 240. However, the low resistance, the medium resistance, and the high resistance which indicate the paper resistance are only examples and the embodiment of FIG. 4 is not limited thereto.

For example, as the paper resistance increases, the second transferring table group may include a plurality of transferring tables formed for a voltage gradually applied from the power source supplying unit 110.

Referring to FIG. 1, the transferring table selecting unit 231 selects any one transferring table which corresponds to the resistance detected by the paper resistance detecting unit 222 from among the transferring tables stored in the memory 240.

The transferring table selecting unit 231 selects any one transferring table which corresponds to the printing environment from among the transferring tables stored in the memory 240 as the first transferring table and selects any one transferring table which corresponds to the paper resistance detected by the paper resistance detecting unit 222 as the second transferring table. That is, the transferring table selecting unit 231 selects the first transferring table which corresponds to the printing environment from among the first transferring table group stored in the first transferring table storage unit 241 and selects the second transferring table which corresponds to the paper resistance detected by the paper resistance detecting unit 222 from among the second transferring table group stored in the second transferring table storage unit 242. Here, it would be apparent to one of ordinary skill in the art to directly measure the printing environment within the image forming apparatus 100.

FIG. 5 is a table for describing a method of selecting the second transferring table by using the detected paper resistance, according to an embodiment. Referring to FIG. 5, a table 51 used to select the transferring table which corresponds to the paper resistance is illustrated, wherein the table 51 includes feedback current 52, an ADC voltage 53, a standard ADC 54, a range 55, and a second transferring table 56.

Here, the feedback current 52 denotes current detected by the paper resistance detecting unit 222 and indicates the paper resistance of the printing paper P. The ADC voltage 53 indicates a voltage value obtained by converting the feedback current 52 into the ADC voltage 53 based on a predetermined voltage. Here, the predetermined voltage is a voltage applied to a feedback circuit connected to the conductive member 210 and may be, for example, 3.3 V. The standard ADC 54 is a value indicating which area the converted ADC voltage 53 corresponds from among the areas in which the predetermined voltage is classified into 1024 areas.

The range 55 indicates a plurality of sizes of paper resistance. In FIG. 5, the plurality of sizes of paper resistance are divided into three areas. However, the embodiment of FIG. 5 is not limited thereto and the plurality of sizes of paper resistance may be divided into at least two areas. The second transferring table 56 indicates groups of the second transferring tables which correspond to areas divided in the range 55. In FIG. 5, Table A, Table B, and Table C for each of the three areas are illustrated.

Here, Table A, Table B, and Table C indicate a high resistance printing paper group, a medium resistance printing paper group, and a low resistance printing paper group, respectively, and each table includes a plurality of transferring tables according to the printing environments as described above.

More specifically, the transferring table selecting unit 231 selects any one second transferring table 56 which corresponds to the range 55 in which the standard ADC 54 is included. That is, when the feedback current 52, which indicates the paper resistance of the printing paper P detected by the paper resistance detecting unit 222, is about 4.4 μA, the ADC voltage 53 which corresponds to 4.4 μA, is about 0.72 V and the standard ADC 54 which corresponds to 0.72 V, is about 223. When the standard ADC 54 is 223, the standard ADC 54 is included in the area of the range 55 of 0 to 280 and thus the printing paper P corresponds to high resistance. The transferring table selecting unit 231 selects the second transferring table which corresponds to the current printing environment from among the transferring tables corresponding to Table A.

Accordingly, since the printing environment and the resistance of the printing paper are considered in the selected second transferring table, a transferring voltage applied to the transferring roller 160 controlled with reference to the second transferring table may not reduce the life of the transferring roller 160 and improve printing quality.

Referring back to FIG. 1, the voltage applying unit 232 applies a transferring voltage to the transferring roller 160, wherein the transferring voltage corresponds to the transferring roll resistance detected by the transferring roll resistance detecting unit 221 with reference to the transferring table corresponding to the paper resistance detected by the paper resistance detecting unit 222. Here, the transferring table corresponding to the paper resistance may correspond to the second transferring table selected from the transferring table selecting unit 231. That is, as described above, the voltage applying unit 232 controls the voltage applied to the transferring roller 160 by using the PWM DR according to the standard ADC which corresponds to the transferring roll resistance detected by the transferring roll resistance detecting unit 221 with reference to the selected transferring table.

For example, when the transferring table selected from the transferring table selecting unit 231 is the transferring table 41 illustrated in FIG. 4, and the standard ADC 42, which corresponds to the transferring roll resistance detected by the transferring roll resistance detecting unit 221, is 533, the PWM DR 43 is 391 in a simplex printing and the PWM DR 43 is 365 in a duplex printing. The voltage applying unit 232 may control a voltage applied to the transferring roller 160 by using the PWM DR 43 such as 391 or 365.

The memory 240 stores the transferring tables. Referring to FIG. 1, the memory 240 includes the first transferring table storage unit 241 and the second transferring table storage unit 242. The first transferring table storage unit 241 stores the transferring tables, which indicate voltage applied to the transferring roller 160 according to the transferring roll resistance for each of the plurality of printing environments, and the second transferring table storage unit 242 stores the transferring tables which indicate voltages applied to the transferring roller 160 according to the transferring roll resistance for each of the plurality of sizes of the paper resistance.

The memory 240 is a common storage medium and includes a read only memory (ROM), a random access memory (RAM), a flash memory, a hard disk which is a magnetic computer memory device, and an optical disk drive. In addition, the memory 240 may be a separate chip. However, the embodiment of FIG. 1 is not limited thereto and the memory 240 may be included in a processor.

The applied voltage controlling unit 250 applies a voltage to the charge roller 130, the development roller 150, and the pressurizing roller 171 by the control of the power source supplying unit 110. Also, when the paper resistance detected by the paper resistance detecting unit 222 increases, the applied voltage controlling unit 250 controls an absolute value of a voltage applied to one of the development roller 150 and the pressurizing roller 171 to be increased.

FIG. 6 is a table 61 for describing a method of controlling the voltage applied to the pressuring roller 171 by using the detected paper resistance, according to an embodiment. Referring to FIG. 6, the table 61 for explaining the method of controlling the voltage applied to the pressurizing roller 171 is illustrated. The table 61 includes a paper resistance 62, a printing environment 63, a PWM DR 64, and a voltage 65.

As illustrated in the table 61, when a reference voltage is 350 V and a PWM DR for the reference voltage is 860, the applied voltage controlling unit 250 may control the voltage applied to the pressurizing roller 171 according to the paper resistance 62 and the printing environment 63 as illustrated in the table 61. For example, when it is assumed that the table 61 is a table for a high temperature and high humidity printing environment 63, the method of controlling the voltage applied to the pressurizing roller 171 is illustrated for the case when the paper resistance detected by the paper resistance detecting unit 222 is low resistance, medium resistance, and high resistance.

When the paper resistance of the printing paper P is medium resistance, the PWM DR 64 is 938 obtained by increasing the low resistance PMW DR 64 by 78 and the voltage is 400 V. That is, when the paper resistance of the printing paper P is medium resistance, the applied voltage controlling unit 250 applies a voltage of 400 V, instead of 350 V, to the pressurizing roller 171.

In the table 61 illustrated in FIG. 6, the method of controlling the voltage applied to the pressurizing roller 171 is illustrated. Also, a voltage applied to the development roller 150 may be controlled using the same method. However, since the voltage applied to the development roller 150 is a negative voltage, the method illustrated in the table 61 is used to apply a voltage to the development roller 150, but the applied voltage is a negative voltage.

Accordingly, when the paper resistance detected by the paper resistance detecting unit 222 increases, the applied voltage controlling unit 250 controls an absolute value of a voltage applied to one of the development roller 150 and the pressurizing roller 171 to be increased.

Referring back to FIG. 1, the conductive member 210 may be located before or after the transferring roller 160 based on a transferring direction of the printing paper P, as illustrated in FIG. 3, which will be described with reference to FIGS. 7 and 8 below.

Figure 7:
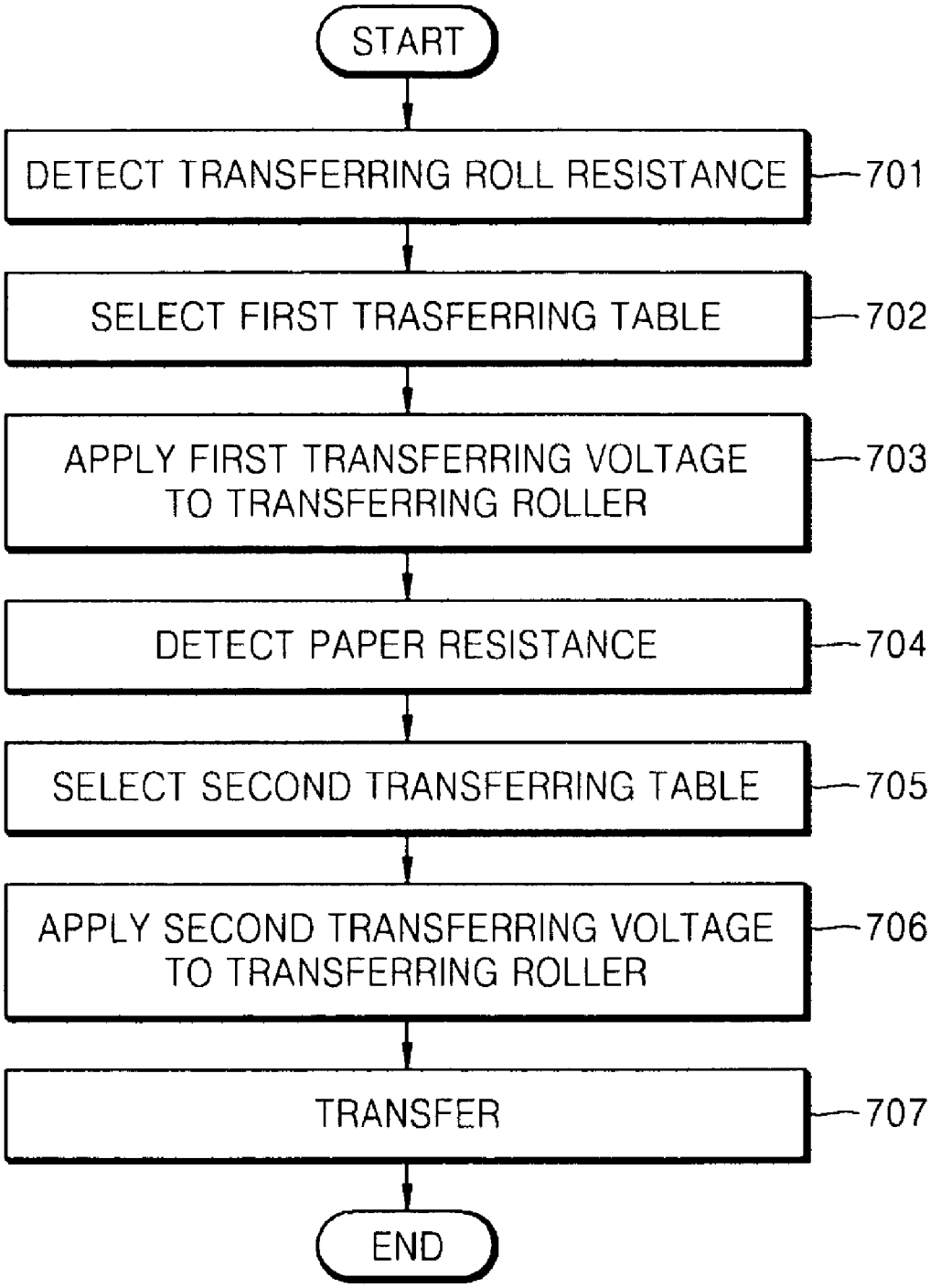
FIG. 7 is a flowchart of a method of controlling a voltage of the image forming apparatus when the conductive member is positioned after a transferring roller based on a transferring direction of a printing paper, according to an embodiment.

FIG. 7 is a flowchart of a method of controlling a voltage of the image forming apparatus 100 when the conductive member 210 is positioned after the transferring roller 160 based on a transferring direction of the printing paper P, according to an embodiment. When the conductive member 210 is after the transferring roller 160, the printing paper P first passes through a transferring nip formed by the transferring roller 160 and the photoconductor drum 120 according to a transferring direction of the printing paper P and then passes between the conductive member 210 and the photoconductor drum 120.

In operation 701, the transferring roll resistance detecting unit 221 detects the transferring roll resistance which indicates the resistance between the transferring roller 160 and the photoconductor drum 120 by applying the first voltage to the transferring roller 160. That is, when the transferring nip is formed by the transferring roller 160 and the photoconductor drum 120, the voltage applying unit 232 applies the first voltage to the transferring roller 160, and the transferring roll resistance detecting unit 221 detects the transferring roller resistance.

In operation 702, the transferring table selecting unit 231 selects the first transferring table with respect to the current printing environment from among the first transferring table group stored in the first transferring table storage unit 241.

In operation 703, the voltage applying unit 232 applies the first transferring voltage to the transferring roller 160, wherein the first transferring voltage corresponds to the transferring roll resistance detected by the transferring roll resistance detecting unit 221 with reference to the selected first transferring table. Here, when the first voltage is applied to the transferring roller 160, the first voltage applied to the transferring roller 160 is converted into the first transferring voltage.

In operation 704, when the printing paper P reaches the conductive member 210, the paper resistance detecting unit 222 detects the paper resistance, which indicates the resistance between the printing paper P and the photoconductor drum 120, by applying the second voltage to the conductive member 210, wherein the printing paper P and the conductive member 210 are spaced apart from each other. That is, the voltage applying unit 232 applies the second voltage to the conductive member 210 while the printing paper P passes between the conductive member 210 and the photoconductor drum 120, and the paper resistance detecting unit 222 detects the paper resistance, wherein the printing paper P and the conductive member 210 are spaced apart from each other.

Here, when the paper resistance is detected by the paper resistance detecting unit 222, the printing paper P and the photoconductor drum 120 contact each other and the printing paper P contacts the transferring roller 160 and the photoconductor drum 120. Accordingly, the paper resistance detected by the paper resistance detecting unit 222 may include resistance of not only the printing paper P and the photoconductor drum 120, but also the transferring roller 160. However, since the second voltage applied to the conductive member 210 is relatively high as compared with the voltage applied to the transferring roller 160, the resistance of the transferring roller 160 is negligible in the paper resistance detected by the paper resistance detecting unit 222.

In operation 705, the transferring table selecting unit 231 selects any one of the second transferring tables which corresponds to the paper resistance detected from among the second transferring table group stored in the second transferring storage unit 242.

In operation 706, the voltage applying unit 232 applies a second transferring voltage to the transferring roller 160, wherein the second transferring voltage corresponds to the transferring roll resistance detected by the transferring roll resistance detecting unit 221 with reference to the transferring table corresponding to the paper resistance detected by the paper resistance detecting unit 222. Here, the transferring table which corresponds to the detected paper resistance corresponds to the second transferring table selected in operation 705. When the first transferring voltage is applied to the transferring roller 160, the first transferring voltage applied to the transferring roller 160 is converted into the second transferring voltage.

In operation 707, the transferring roller 160, to which the second transferring voltage is applied, performs transferring on the printing paper P.

Referring to FIG. 7, when the first transferring voltage is applied to the transferring roller 160 and the printing paper P passes between the conductive member 210 and the photoconductor drum 120, operations 704 and 705 are performed.

Accordingly, operations 704 and 705 are performed at a front end of the printing paper P (for example, 15 mm from the top edge of the printing paper P). While the second transferring voltage is controlled by the transferring voltage controlling unit 230, that is, while operations 704 and 705 are performed, a transferring process may be performed onto the front end of the printing paper P by the first transferring voltage so that the quality of an image is prevented from deteriorating during the transferring process for the front end of the printing paper P.

Figure 8:
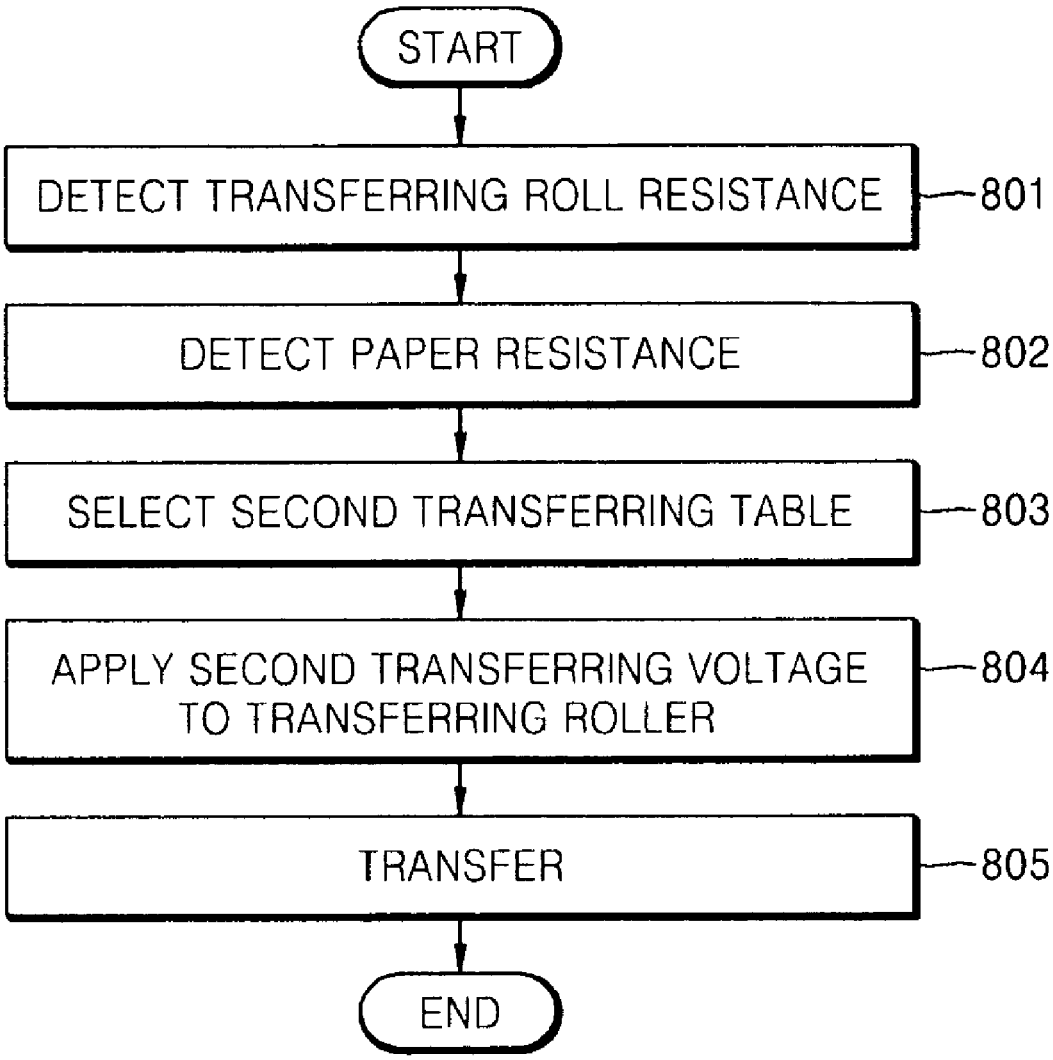
FIG. 8 is a flowchart of a method of controlling a voltage of the image forming apparatus when the conductive member is before the transferring roller based on a transferring direction of the printing paper, according to an embodiment.

FIG. 8 is a flowchart illustrating a method of controlling a voltage of the image forming apparatus 100 when the conductive member 210 is before the transferring roller 160 based on a transferring direction of the printing paper P, according to an embodiment. When the conductive member 210 is before the transferring roller 160, the printing paper P first passes between the conductive member 210 and the photoconductor drum 120 according to a transferring direction of the printing paper P and then passes through a transferring nip formed by the transferring roller 160 and the photoconductor drum 120.

In operation 801, the transferring roll resistance detecting unit 221 detects the transferring roll resistance which indicates the resistance between the transferring roller 160 and the photoconductor drum 120 by applying the first voltage to the transferring roller 160.

In operation 802, when the printing paper P reaches the conductive member 210, the paper resistance detecting unit 222 detects the paper resistance, which indicates the resistance between the printing paper P and the photoconductor drum 120, by applying the second voltage to the conductive member 210, wherein the printing paper P and the conductive member 210 are spaced apart from each other. That is, the voltage applying unit 232 applies the second voltage to the conductive member 210 while the printing paper P passes between the conductive member 210 and the photoconductor drum 120, and the paper resistance detecting unit 222 detects the paper resistance.

In operation 803, the transferring table selecting unit 231 selects any one of the second transferring tables which corresponds to the paper resistance detected from among the second transferring table group stored in the second transferring storage unit 242.

In operation 804, the voltage applying unit 232 applies the second transferring voltage to the transferring roller 160, wherein the second transferring voltage corresponds to the transferring roll resistance detected by the transferring roll resistance detecting unit 221 with reference to the transferring table corresponding to the paper resistance detected by the paper resistance detecting unit 222. Here, the transferring table which corresponds to the detected paper resistance corresponds to the second transferring table selected in operation 803. When the first voltage is applied to the transferring roller 160, the first voltage applied to the transferring roller 160 is converted into the second transferring voltage.

In operation 805, the transferring roller 160, to which the second transferring voltage is applied, performs transferring on the printing paper P.

Accordingly, when the conductive member 210 is before the transferring roller 160 based on the transferring direction of the printing paper P, the voltage applied to the transferring roller 160 may be controlled by using the paper resistance detected by the paper resistance detecting unit 222 of the apparatus 200 to control a voltage. Also, as described above, the paper resistance detected by the paper resistance detecting unit 222 may be used to control a voltage applied to the development roller 150 and the pressurizing roller 171.

Referring to FIGS. 7 and 8, the method of controlling a voltage of the image forming apparatus 100 includes operations processed in the image forming apparatus 100 illustrated in FIG. 1 in sequence according to time. Accordingly, although descriptions are omitted, details described with reference to the image forming apparatus 100 of FIG. 1 may be applied to the method of controlling the voltage of the image forming apparatus 100.

Figure 9:
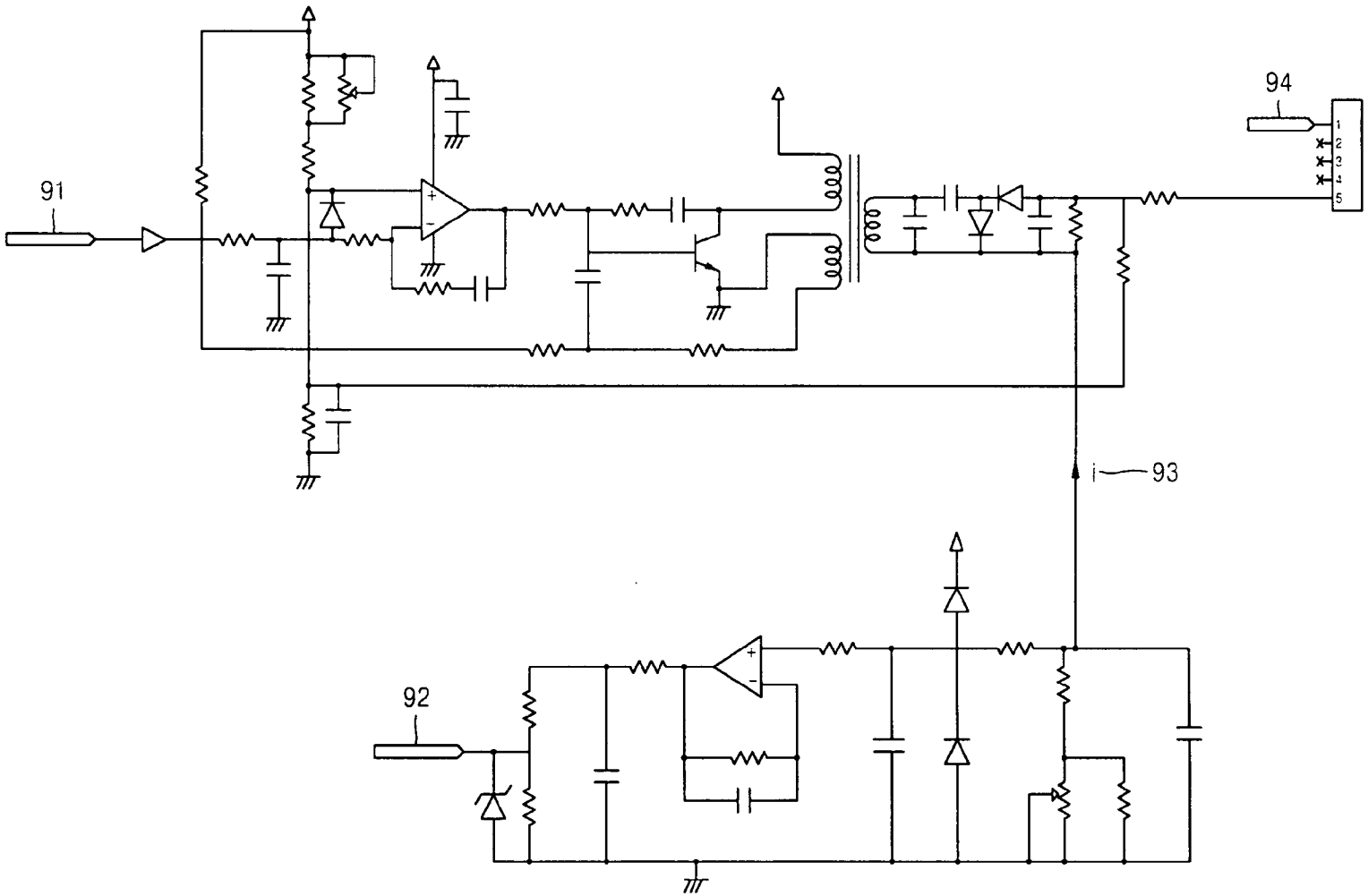
FIG. 9 is a circuit diagram illustrating a feedback circuit connected to the conductive member, according to an embodiment.

FIG. 9 is a circuit diagram illustrating the feedback circuit connected to the conductive member 210, according to an embodiment. Elements such as power source, resistors, inductors, capacitors, and transistors control the conductive member 210 in order for the paper resistance detecting unit 222 to detect the paper resistance and operate to apply a transferring voltage to the transferring roller 160 via the transferring voltage controlling unit 230.

As illustrated in the feedback circuit of FIG. 9, the second voltage is applied to the conductive member 210 through an input terminal 91. For example, the second voltage may be 2 kV. Also, an ADC voltage which corresponds to the feedback current is output through an output terminal 92. In addition, a current 93 may be fed back and a power source is applied from the power source supplying unit 110 through a terminal 94.

Figure 10:
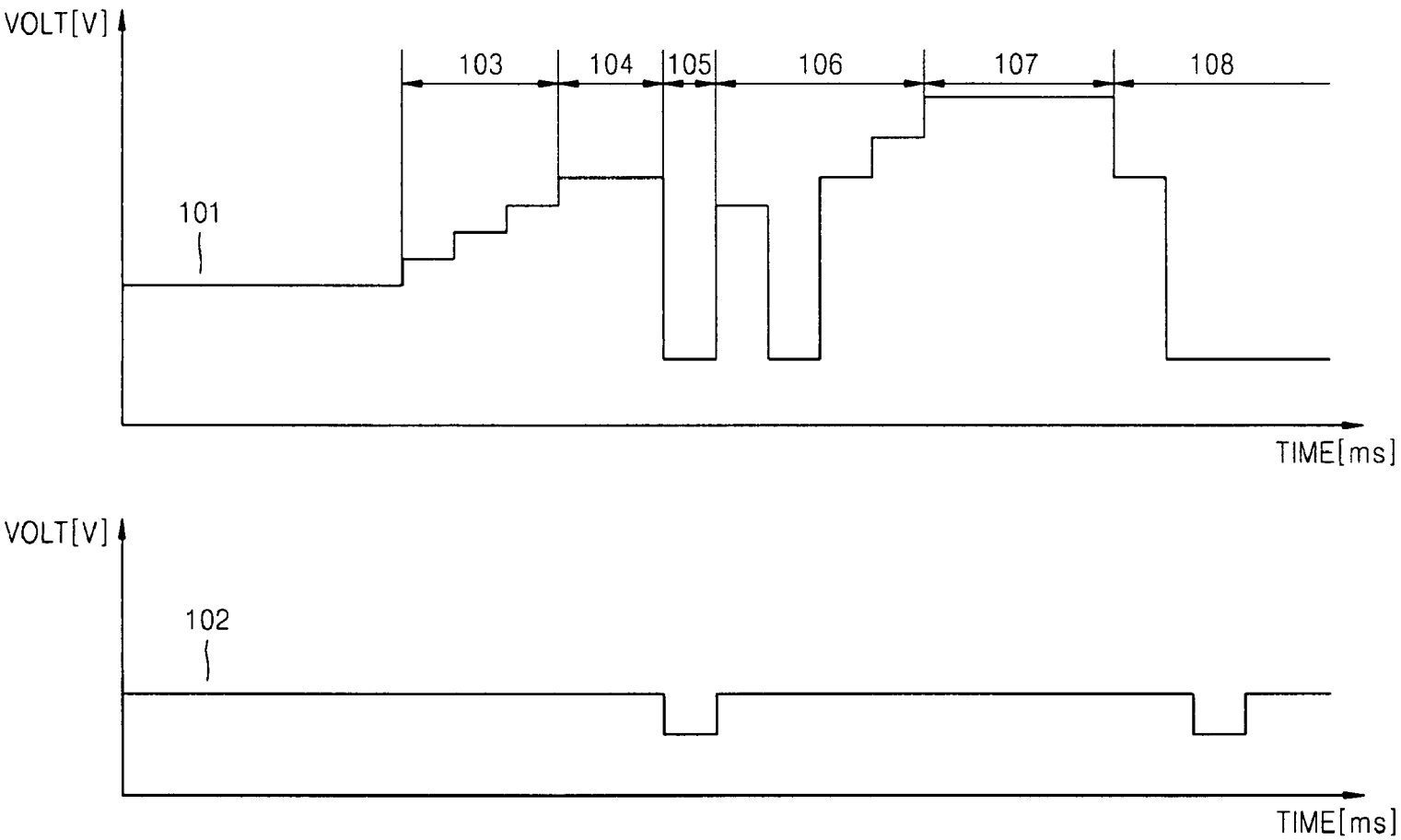
FIG. 10 is a timing diagram illustrating a voltage applied to a transferring roller and an output of the feedback circuit applied to the conductive member, according to an embodiment.

FIG. 10 is a timing diagram illustrating a voltage 101 applied to the transferring roller 160 and an output 102 of the feedback circuit applied to the conductive member 210, according to an embodiment.

Referring to FIG. 10, the voltage 101 applied to the transferring roller 160 and the output 102 of the feedback circuit applied to the conductive member 210 are illustrated. The timing diagram illustrated in FIG. 10 corresponds to the case when the conductive member 210 is after the transferring roller 160 based on a transferring direction of the printing paper P.

During section 103, the voltage 101 is gradually applied to the transferring roller 160 from the power source supplying unit 110 according to the control of the transferring voltage controlling unit 230. The voltage is gradually applied to prevent overshoot.

During section 104, the first voltage is applied to the transferring roller 160 from the power source supplying unit 110 according to the control of the transferring voltage controlling unit 230. Here, the first voltage is used to detect the transferring roll resistance and may be, for example, about 1400 V.

During section 105, the second voltage is applied to the conductive member 210 from the power source supplying unit 110 according to the control of the transferring voltage controlling unit 230. Here, the second voltage is used to detect the paper resistance and may be, for example, about 2 kV.

During section 106, the first transferring voltage is applied to the transferring roller 160 from the power source supplying unit 110 according to the control of the transferring voltage controlling unit 230. Also, the voltage is gradually applied to apply the second transferring voltage. The voltage is gradually applied so as to prevent overshoot.

During section 107, the second transferring voltage is applied to the transferring roller 160 from the power source supplying unit 110 according to the control of the transferring voltage controlling unit 230. That is, the second transferring voltage is applied to the transferring roller 160 from the power source supplying unit 110 according to the control of the transferring voltage controlling unit 230 by using the paper resistance detected as the second voltage is applied during the section 105.

During section 108, sections 103 through 107 are repeated for a next paper.

Due to long term use of the image forming apparatus 100, the life of the transferring roller 160 elapses so that resistance of the transferring roller 160 increases and it may not be possible to predict the increased resistance. Accordingly, the conductive member 210 of the apparatus 200 to control a voltage which controls the image forming apparatus 100 is used to control a transferring voltage regardless of a resistance change of the transferring roller 160.

In addition, a transferring error occurring due to an error of a transferring voltage may be prevented and an image damaged due to an excessive voltage generated since the paper resistance according to the resistance change is not accurately measured may be prevented.

As described above, since the resistance of the printing paper changes, the quality of an image formed on the printing paper is prevented from deteriorating. In addition, since the resistance of the transferring roller 160 changes due to long use of the transferring roller 160, the quality of an image formed on the printing paper P is prevented from deteriorating.

The embodiments can be implemented in computing hardware (computing apparatus) and/or software, such as (in a non-limiting example) any computer that can store, retrieve, process and/or output data and/or communicate with other computers. The results produced can be displayed on a display of the computing hardware. A program/software implementing the embodiments may be recorded on computer-readable media comprising computer-readable recording media. The program/software implementing the embodiments may also be transmitted over transmission communication media. Examples of the computer-readable recording media include a magnetic recording apparatus, an optical disk, a magneto-optical disk, and/or a semiconductor memory (for example, RAM, ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

Further, according to an aspect of the embodiments, any combinations of the described features, functions and/or operations can be provided.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. A method of controlling a voltage of an image forming apparatus, the method comprising:

detecting a transferring roll resistance, which indicates a resistance between a transferring roller and a photoconductor drum, comprising applying a first voltage to the transferring roller;

when a printing paper reaches a conductive member of which one surface thereof is opposite to the photoconductor drum, detecting a paper resistance, which indicates a resistance between the printing paper and the photoconductor drum, comprising applying a second voltage to the conductive member, wherein the printing paper and the conductive member are spaced apart from each other;

applying a transferring voltage, which corresponds to the detected transferring roll resistance, to the transferring roller with reference to a transferring table which corresponds to the detected paper resistance; and performing transferring on the printing paper comprising using the transferring roller to which the transferring voltage is applied.

2. The method of claim 1, wherein the one surface of the conductive member is a plate comprising at least one saw tooth facing the photoconductor drum.

3. The method of claim 1, wherein the detecting of the paper resistance, comprises using a current sensed a plurality of times in a predetermined time interval, when one edge of the printing paper reaches the conductive member.

4. The method of claim 1, further comprising:

selecting any one transferring table which corresponds to the detected paper resistance from among transferring tables, which indicate voltage applied to the transferring roller according to the transferring roll resistance, for each of a plurality of sizes of the paper resistance, wherein the applying of the transferring voltage comprises applying the transferring voltage, which corresponds to the detected transferring roll resistance, to the transferring roller with reference to the selected transferring table, and the performing of transferring comprises using the transferring roller to which the transferring voltage is applied.

5. The method of claim 4, wherein the applying of the transferring voltage further comprises:

applying a first transferring voltage, which corresponds to the detected transferring roll resistance, to the transferring roller with reference to a first one of the transferring tables, which indicates a voltage applied to the transferring roller according to the transferring roll resistance and is not related to the paper resistance, and applying a second transferring voltage, which corresponds to the detected transferring roll resistance, to the transferring roller with reference to a second one of the transferring tables, which is the selected transferring table.

6. The method of claim 1, further comprising controlling a voltage applied to at least any one of a development roller and a pressurizing roller or combinations thereof, according to the detected paper resistance.

7. The method of claim 6, wherein the controlling the voltage applied to at least one of the development roller and the pressurizing roller comprises applying an absolute value of the voltage applied and increasing the applied voltage when the detected paper resistance increases.

8. A computer-readable recording medium having embodied thereon a computer program for executing the method of claim 1.

9. An apparatus to control a voltage of an image forming apparatus, the apparatus comprising:

a conductive member having a surface opposite to a photoconductor drum of the image forming apparatus;

a transferring roll resistance detecting unit to detecting a transferring roll resistance, which indicates the resistance between a transferring roller of the image forming apparatus, to which a first voltage is applied, and the photoconductor drum;

a paper resistance detecting unit to detect a paper resistance, which indicates the resistance between a printing paper passing through the image forming apparatus, which reaches the conductive member to which a second voltage is applied, and the photoconductor drum, wherein the printing paper and the conductive member are spaced apart from each other; and a voltage applying unit to apply a transferring voltage, which corresponds to the detected transferring roll resistance, to the transferring roller with reference to a transferring table which corresponds to the detected paper resistance.

10. The apparatus of claim 9, wherein the surface of the conductive member is a plate comprising at least one saw tooth facing the photoconductor drum.

11. The apparatus of claim 10, wherein an end part of the saw tooth included in the conductive member has a shape to discharge to the printing paper the voltage applied to the conductive member.

12. The apparatus of claim 9, wherein the paper resistance detecting unit detects the paper resistance by using a current sensed a plurality of times in a predetermined time interval, when one edge of the printing paper reaches the conductive member.

13. The apparatus of claim 9, further comprising:

a memory to store transferring tables, which indicate a voltage applied to the transferring roller, according to transferring roll resistance, for each of a plurality of sizes of the paper resistance; and a transferring table selecting unit to select one of the transferring tables which corresponds to the detected paper resistance from among the stored transferring tables.

14. The apparatus of claim 13, wherein:

the conductive member is positioned after the transferring roller based on a transferring direction of the printing paper, the memory further stores the transferring tables, which indicate voltages applied to the transferring roller according to the transferring roll resistance, and which are not related to the paper resistance, the transferring table selecting unit selects one transferring table, which corresponds to a current printing environment, as a first transferring table and selects one transferring table, which corresponds to the detected paper resistance, as a second transferring table, and the voltage applying unit applies a first transferring voltage, which corresponds to the detected transferring roll resistance, to the transferring roller with reference to the first transferring table and applies a second transferring voltage, which corresponds to the detected transferring roll resistance, to the transferring roller with reference to the second transferring table.

15. The apparatus of claim 9, further comprising an applied voltage controlling unit to control a voltage applied to at least one of a development roller and a pressurizing roller of the image forming apparatus, or combinations thereof, according to the detected paper resistance.

16. The apparatus of claim 15, wherein the applied voltage controlling unit controls an absolute value of the voltage applied to the one of the development roller and the pressurizing roller to be increased when the detected paper resistance increases.

17. An image forming apparatus comprising:

a photoconductor drum;

a charge roller to charge the photoconductor drum;

a laser scanning unit to form an electrostatic latent image on the charged photoconductor drum;

a development roller to develop a visible image to the photoconductor drum on which the electrostatic latent image is formed;

a transferring roller to transfer the visible image developed to the photoconductor drum to a printing paper;

a fixing unit to fix the transferred visible image to the printing paper; and an apparatus to control a voltage applied to the transferring roller according to a paper resistance, which indicates the resistance between the printing paper and the photoconductor drum;

wherein the apparatus to control a voltage detects the paper resistance by using a conductive member and the printing paper and the conductive member are spaced apart from each other.

18. The apparatus of claim 17, wherein the conductive member comprises at least one saw tooth facing the photoconductor drum and detects the paper resistance.

19. The apparatus of claim 17, wherein the apparatus to control a voltage applies a transferring voltage to the transferring roller with reference to a transferring table which corresponds to the detected paper resistance.

20. The apparatus of claim 17, wherein the apparatus to control a voltage detects the paper resistance by using a current sensed a plurality of times in a predetermined time interval, when one edge of the printing paper reaches the conductive member.

* * * * *